US010297239B2

(12) United States Patent
Kasuga et al.

(10) Patent No.: US 10,297,239 B2
(45) Date of Patent: May 21, 2019

(54) ELECTRONIC WIND INSTRUMENT CAPABLE OF PERFORMING A TONGUING PROCESS

(71) Applicant: CASIO COMPUTER CO., LTD., Shibuya-ku, Tokyo (JP)

(72) Inventors: Kazutaka Kasuga, Fussa (JP); Hideo Hamanaka, Akiruno (JP); Eiichi Harada, Hamura (JP); Chihiro Toyama, Hachioji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/987,711

(22) Filed: May 23, 2018

(65) Prior Publication Data

US 2019/0005931 A1 Jan. 3, 2019

(30) Foreign Application Priority Data

Jun. 29, 2017 (JP) ..... 2017-127718

(51) Int. Cl.
*G10H 1/06* (2006.01)
*G10H 1/14* (2006.01)
(Continued)

(52) U.S. Cl.
CPC ..... *G10H 1/14* (2013.01); *G10H 1/0008* (2013.01); *G10H 1/0551* (2013.01);
(Continued)

(58) Field of Classification Search
CPC .. G10H 3/16; G10H 1/46; G10H 1/44; G10H 1/32; G10H 2220/361; G10H 2230/205;
(Continued)

(56) References Cited

U.S. PATENT DOCUMENTS 5,340,942 A 8/1994 Kunimoto
5,459,280 A * 10/1995 Masuda ..... G10H 1/055 84/622

(Continued)

FOREIGN PATENT DOCUMENTS

JP 04116696 A 4/1992
JP H05333864 A 12/1993

(Continued)

OTHER PUBLICATIONS

Extended European Search Report (EESR) dated Oct. 2, 2018 issued in counterpart European Application No. 18179298.7.

*Primary Examiner* — Jeffrey Donels
(74) *Attorney, Agent, or Firm* — Holtz, Holtz & Volek PC

(57) ABSTRACT

An electronic wind instrument is provided with a processor (CPU 5) and plural touch sensors (a detecting unit 12*s* and detecting units 13*s*) disposed along a first direction. A first output variable da/dt is obtained, representing a variation per unit time of an output value from a first sensor (detecting unit 12*s*) in the plural touch sensors disposed on the side close to first end (tip side) in the first direction. A second output variable dS/dt is obtained, representing a variation per unit time of a sum of output values from second sensors (detecting units 13*s*) disposed between a second end (heel side) and the first sensor in the first direction. The processor judges based on the first output variable da/dt and the second output variable dS/dt whether a tonging process should be performed.

14 Claims, 14 Drawing Sheets

(51) Int. Cl.
*G10H 1/055* (2006.01)
*G10H 1/00* (2006.01)

(52) U.S. Cl.
CPC . *G10H 2210/095* (2013.01); *G10H 2220/265* (2013.01); *G10H 2220/361* (2013.01); *G10H 2230/205* (2013.01)

(58) Field of Classification Search
CPC .. G10H 1/0551; G10H 2230/221; G10H 1/14; G10H 1/0008; G10H 2220/265
USPC ..... 84/723, 615, 622
See application file for complete search history.

(56) References Cited

U.S. PATENT DOCUMENTS

| | | | | |
|---|---|---|---|---|
| 5,543,580 | A * | 8/1996 | Masuda | G10H 1/055 84/723 |
| 7,723,605 | B2 * | 5/2010 | Gremo | G10H 1/344 84/615 |
| 8,581,087 | B2 * | 11/2013 | Hashimoto | G10H 1/0008 84/615 |
| 9,653,057 | B2 | 5/2017 | Harada et al. | |
| 9,984,669 | B2 * | 5/2018 | Toyama | G10H 1/0551 |
| 2007/0017346 | A1 * | 1/2007 | Masuda | G10H 1/053 84/600 |

FOREIGN PATENT DOCUMENTS

| | | | |
|---|---|---|---|
| JP | 2016177026 | A | 10/2016 |
| WO | 2008141459 | A1 | 11/2008 |

* cited by examiner

ELECTRONIC WIND INSTRUMENT CAPABLE OF PERFORMING A TONGUING PROCESS

CROSS-REFERENCE TO RELATED APPLICATION

The present application is based upon and claims the benefit of priority from the prior Japanese Patent Application No. 2017-127718, filed Jun. 29, 2017, the entire contents of which are incorporated herein by reference.

BACKGROUND OF THE INVENTION

1. Field of the Invention

The present invention relates to an electronic wind instrument and a method of controlling the electronic wind instrument.

2. Description of the Related Art

In an electronic wind instrument reproduced from a wind instrument of a single reed type, a technology is proposed, for example, in Japanese Unexamined Patent Publication No. 2016-177026, which technology detects positions of the lip and the tongue of a player, using plural touch sensors including a tongue sensor and lip sensors disposed on a reed of the instrument to control musical tones. The tongue sensor detects tongue touching to generate an output value and the lip sensors detect lip touching to generate output values. The musical tones are controlled based on these generated output values.

SUMMARY OF THE INVENTION

According to one aspect of the invention therein provided an electronic wind instrument which comprises plural touch sensors disposed on the wind instrument along a first direction, and a processor which judges based on a first output variable and a second output variable whether a tonging process should be performed, wherein the first output variable represents a variation per unit time of an output value from a first sensor among the plural touch sensors, which first sensor is disposed on the side close to a first end in the first direction, and the second output variable represents a variation per unit time of output values from at least one or more second sensors among the plural touch sensors which are disposed between a second end in the first direction and the first sensor.

According to another aspect of the invention, there is provided a method of judging based on a first output variable and a second output variable whether a tonging process should be performed in an electronic wind instrument, wherein the electronic wind instrument has plural touch sensors disposed on the wind instrument along a first direction, the first output variable represents a variation per unit time of an output value from a first sensor among the plural touch sensors, which first sensor is disposed on the side close to a first end in the first direction, and the second output variable represents a variation per unit time of output values from at least one or more second sensors among the plural touch sensors which are disposed between a second end in the first direction and the first sensor.

According to other aspect of the invention, there is provided a non-transitory computer-readable recording medium with an executable program stored thereon, the executable program, when installed on a computer, making the computer judge based on a first output variable and a second output variable whether a tonging process should be performed, wherein the computer is mounted on an electronic wind instrument having plural touch sensors disposed on the wind instrument along a first direction, the first output variable represents a variation per unit time of an output value from a first sensor among the plural touch sensors, which first sensor is disposed on the side close to a first end in the first direction, and the second output variable represents a variation per unit time of output values from at least one or more second sensors among the plural touch sensors which are disposed between a second end in the first direction and the first sensor.

DETAILED DESCRIPTION OF THE PREFERRED EMBODIMENTS

Now, an embodiment of the present invention will be described with reference to the accompanying drawings in detail.

Figure 1A:
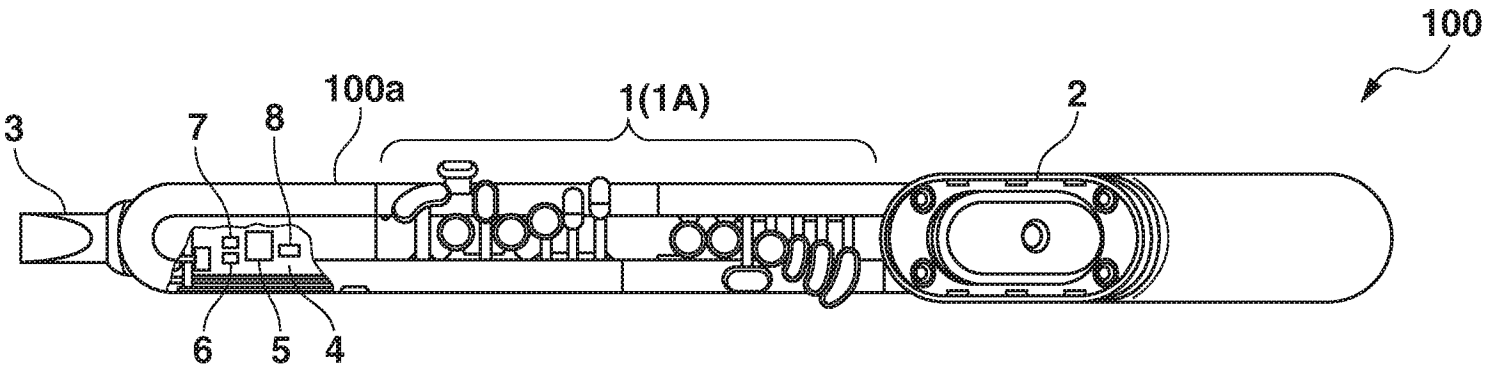
FIG. 1A is a front view showing an electronic wind instrument according to the embodiment of the present invention, the part of which instrument is partially cut off to illustrate the inside of the wind instrument.
Figure 1B:
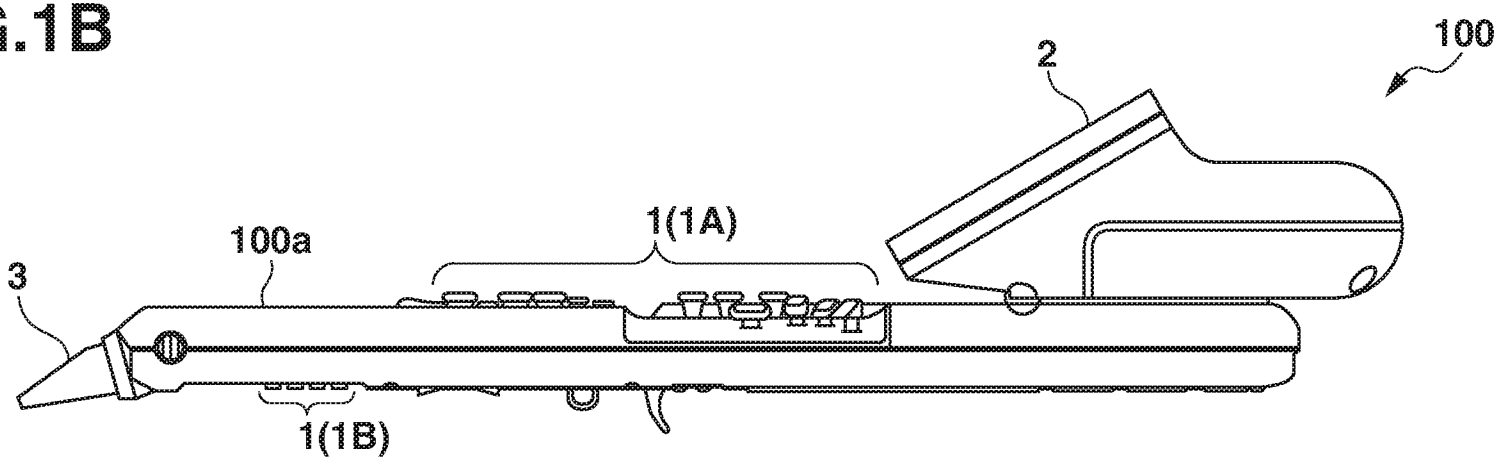
FIG. 1B is a side view showing the electronic wind instrument according to the embodiment of the present invention.

FIG. 1A and FIG. 1B are views showing an electronic wind instrument according to the embodiment of the present invention. FIG. 1A is a front view showing the electronic wind instrument 100 according to the embodiment of the invention, the tube part 100*a* thereof being partially cut off to illustrate the inside of the wind instrument. FIG. 1B is a side view showing the electronic wind instrument 100 according to the embodiment of the invention.

Figure 2:
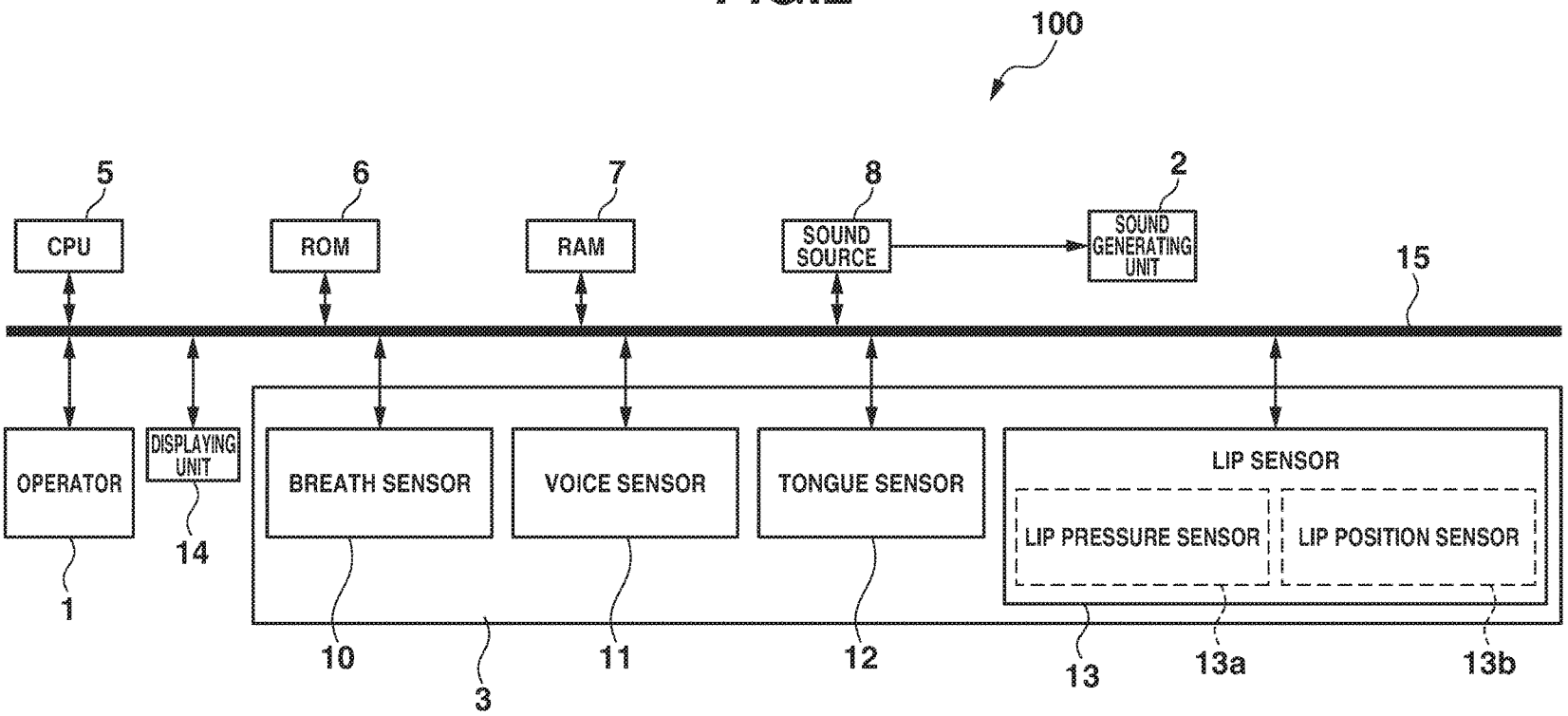
FIG. 2 is a block diagram showing a configuration of the controlling system of the electronic wind instrument.

FIG. 2 is a block diagram showing a configuration of the controlling system of the electronic wind instrument 100.

Figure 3:
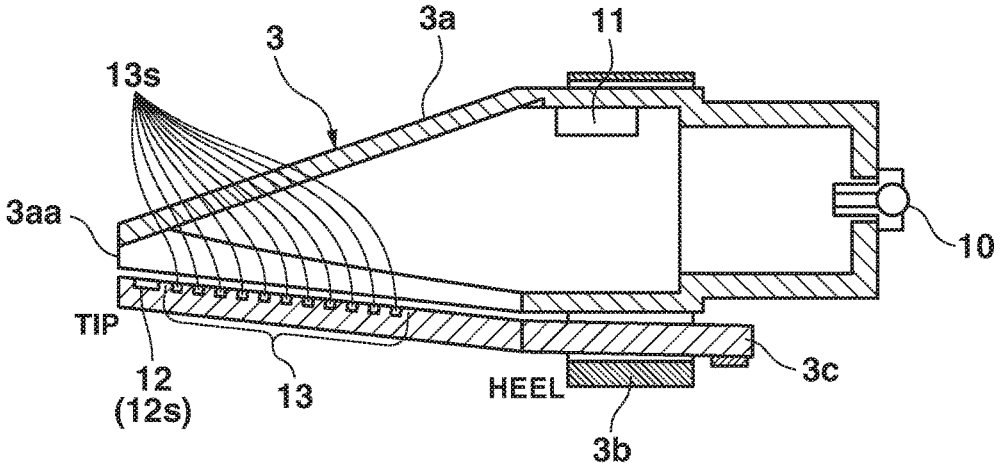
FIG. 3 is a cross sectional view showing a mouthpiece of the electronic wind instrument according to the embodiment of the present invention.

FIG. 3 is a cross sectional view showing a mouthpiece 3 of the electronic wind instrument 100.

In the present embodiment of the invention, a saxophone will be taken and explained as an example of the electronic wind instrument 100. The electronic wind instrument 100 according to the invention may be any electronic wind instrument other than the saxophone, and for example, may be an electronic clarinet.

As shown in FIG. 1A and FIG. 1B, the electronic wind instrument 100 is composed of the tube part 100*a* formed in a saxophone shape, an operator 1 including plural performance keys 1A arranged on the outer surface of the tube part 100*a*, a sound generating unit 2 provided on a bell side of the tube part 100*a*, and the mouthpiece 3 provided on the neck side of the tube part 100*a*.

Further as shown in FIG. 1A, the electronic wind instrument 100 has a substrate 4 provided within the tube part 100*a*. On the substrate 4, there are provided CPU (Central Processing Unit) 5, ROM (Read Only Memory) 6, RAM (Random Access Memory) 7, and a sound source 8.

The mouthpiece 3 shown in FIG. 3 is composed of a mouthpiece body 3*a*, a fixing metal 3*b*, a reed 3*c*, a breath sensor 10, and a voice sensor 11.

The reed 3*c* has a tongue sensor 12 and a lip sensor 13. As will be described later, the lip sensor 13 will function as a lip pressure sensor 13*a* and a lip position sensor 13*b*.

The electronic wind instrument 100 has a displaying unit 14 (Refer to FIG. 2) provided on the external surface of the tube part 100*a*.

For instance, the displaying unit 14 is composed of a liquid crystal displaying unit with a touch sensor, which displays various sorts of data and allows a player or a user to perform various setting operations.

The various elements such as the operator 1, the CPU 5, the ROM 6, the RAM 7, the sound source 8, the breath sensor 10, the voice sensor 11, the tongue sensor 12, the lip sensor 13, and the displaying unit 14 are connected to each other through a bus 15.

The operator 1 is an operation unit which the player (the user) operates with his/her finger(s). The operator 1 includes performance keys 1A for designating a pitch of a tone, and setting keys 1B for setting a function of changing a pitch in accordance with a key of a musical piece and a function of fine adjusting the pitch.

The sound generating unit 2 outputs a musical tone signal supplied from the sound source 8, which will be described later. In the present embodiment of the invention, the sound generating unit 2 is built in the electronic wind instrument 100 (a built-in type), but the sound generating unit 2 may be connected to an output board (not shown) of the electronic wind instrument 100 (a detachable type).

The CPU 5 serves as a controlling unit for controlling the whole operation of the electronic wind instrument 100. The CPU 5 reads a designated program from the ROM 6 and expands it over the RAM 7 to execute the expanded program, performing various processes.

Further, depending on the breathing operation by the player detected by the breath sensor 10, the CPU 5 outputs control data to the sound source 8 to control tone generation and/or tone silence to be performed by the sound generating unit 2.

The ROM 6 is a read only storage which stores programs to be used by the CPU 5, that is, a controlling unit to control operation of various elements of the electronic wind instrument 100 and also stores various data to be used by the CPU 5 to perform various processes such as a breath detecting process, a voice detecting process, a lip position detecting process, a tonguing operation detecting process, a tone silence effect deciding process, a synthetic ratio deciding process, an envelop deciding process, and a tone generation instructing process.

The RAM 7 is a rewritable storage and is used as a work area which temporarily stores a program and data obtained by various sensors such as the breath sensor 10, the voice sensor 11, the tongue sensor 12, and the lip sensor 13.

Further, the RAM 7 serves as a storing unit which stores various sorts of information including, for instance, breath detecting information, voice detecting information, lip position detecting information, tonguing operation detecting information, tone silence effect information, synthetic ratio information, envelop information, and tone generation instructing information. These sorts of information are obtained respectively, when the CPU 5 has performed the breath detecting process, the voice detecting process, the lip position detecting process, the tonguing operation detecting process, the tone silence effect deciding process, the synthetic ratio deciding process, the envelop deciding process, and the tone generation instructing process, contents of which are stored in the ROM 6.

In accordance with an instruction of the CPU 5, these sorts of information are supplied from the sound generating unit 2 to the sound source 8 as control data for controlling the tone generation and/or the tone silence.

The sound source 8 generates a musical tone signal in accordance with the control data which the CPU 5 generates based on the operation information of the operator 1 and the data obtained by the sensors. The generated musical tone signal is supplied from the CPU 5 to the sound generating unit 2.

The mouthpiece 3 is a part which the player holds in his/her mouth, when the player (user) plays the wind instrument. The mouthpiece 3 is provided with various sensors including the breath sensor 10, the voice sensor 11, the tongue sensor 12, and the lip sensor 13 to detect various playing operations performed by the player using tongue, breath, and voice.

More specifically, these sensors including the breath sensor 10, the voice sensor 11, the tongue sensor 12, and the lip sensor 13 will be described. Hereinafter, only the functions of these sensors will be described, but the description of the functions of these sensors by no means prevents from providing these sensors with any additional function.

The breath sensor 10 has a pressure sensor which measures a breathing volume and a breathing pressure, when the player has blown breath from a breathing opening 3*aa* formed at the tip of the mouthpiece body 3*a*, and outputs a breath value. The breath value output from the breath sensor 10 is used by the CPU 5 to set tone generation and/or tone silence of a musical tone and a tone volume of the musical tone.

The voice sensor 11 has a microphone. The voice sensor 11 detects vocal data (a growl waveform) of growl performance by the player. The vocal data (growl waveform) detected by the voice sensor 11 is used by the CPU 5 to determine a synthetic ratio of growl waveform data.

The tongue sensor 12 is a pressure sensor or a capacitance sensor, which has a detecting unit 12*s* serving as a touch sensor and provided at the forefront (a first end) (tip side) of the reed 3*c*, as shown in FIG. 3. The detecting unit 12*s* has a function of a first sensor. The tongue sensor 12 judges whether the tongue of the player has touched the first end of the reed 3*c*.

The tongue sensor 12 detects whether the player has touched the first end of the reed 3*c* with his/her tongue, in other words, judges whether the player has performed a tonguing operation.

The judgment made by the tongue sensor 12 on whether the tongue of the player has touched the first end of the reed 3*c* is used by the CPU 5 to set atone silence effect of a musical tone.

More specifically, the waveform data to be output is adjusted depending on both the state, in which the tongue sensor 12 judges that the tongue is in touch with the first end of the reed 3*c* and the state, in which the breath value is being output by the breath sensor 10. In setting the tone silence effect, the output waveform data is adjusted such that a tone volume will be turned down and the adjusted output waveform can be changed form the original waveform or can keep the same as the original waveform, either will do.

The lip sensor 13 is a pressure sensor or a capacitance sensor, which is composed of plural detecting units 13*s* (or plural touch sensors) arranged along a first direction from the forefront (the first end) (the tip side) toward a second end (the heel side) of the reed 3*c*. The detecting units 13*s* function as second sensors, respectively.

The lip sensor 13 functions as a lip pressure sensor 13*a* and a lip position sensor 13*b*.

More particularly, the lip sensor 13 performs the function of the lip position sensor 13*b* which judges which unit 13*s* among the plural detecting units 13*s* outputs an output value to detect a position of the lip and also performs the function of the lip pressure sensor 13*a* which detects the touching pressure applied to the lip sensor 13 by the touching lip.

When the plural detecting units 13*s* of the lip sensor 13 detect that the lip touches the lip sensor 13, then the CPU 5 calculates the center (hereinafter, also referred to as the "centroid position") of the region where the lip touches, based on the output values supplied from such plural detecting units 13*s*, whereby a "lip position" is obtained.

For instance, when the lip sensor 13 is composed of the pressure sensor, the pressure sensor detects a lip touching pressure (lip pressure) based on the pressure variation applied by the touching lip and the CPU 5 calculates the lip position based on the detected lip touching pressure.

Meanwhile, when the lip sensor 13 is composed of plural capacitance sensors, the lip sensor 13 detects a capacitance variation and the CPU 5 calculates the lip position based on the capacitance variation detected by the capacitance sensors.

The lip touching pressure (lip pressure) detected by the lip pressure sensor 13*a* of the lip sensor 13 and the lip position detected by the lip position sensor 13*b* of the lip sensor 13 are used to control a vibrato performance and a sub-tone performance.

More particularly, the CPU 5 detects the vibrato performance based on a variation in the lip touching pressure (lip pressure) to effect a process corresponding to the vibrato and detects the sub-tone performance based on variations in the lip position (variation of the lip position and variation of the lip touching area) to effect a process corresponding to the sub-tone.

Hereinafter, a method of deciding the lip position will be described briefly, in the case where the lip sensor 13 is composed of the capacitance sensor.

Figure 4A:
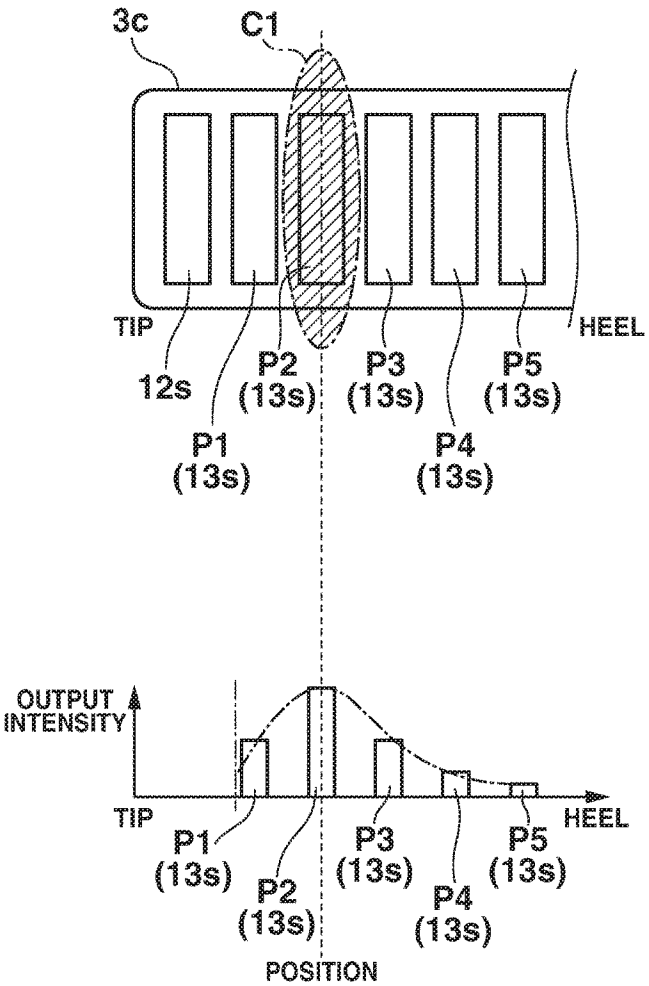
FIG. 4A and FIG. 4B are views schematically showing an area of the reed 3*c* where the lip touches and output values (output intensities) from plural detecting units of a lip sensor.
Figure 4B:
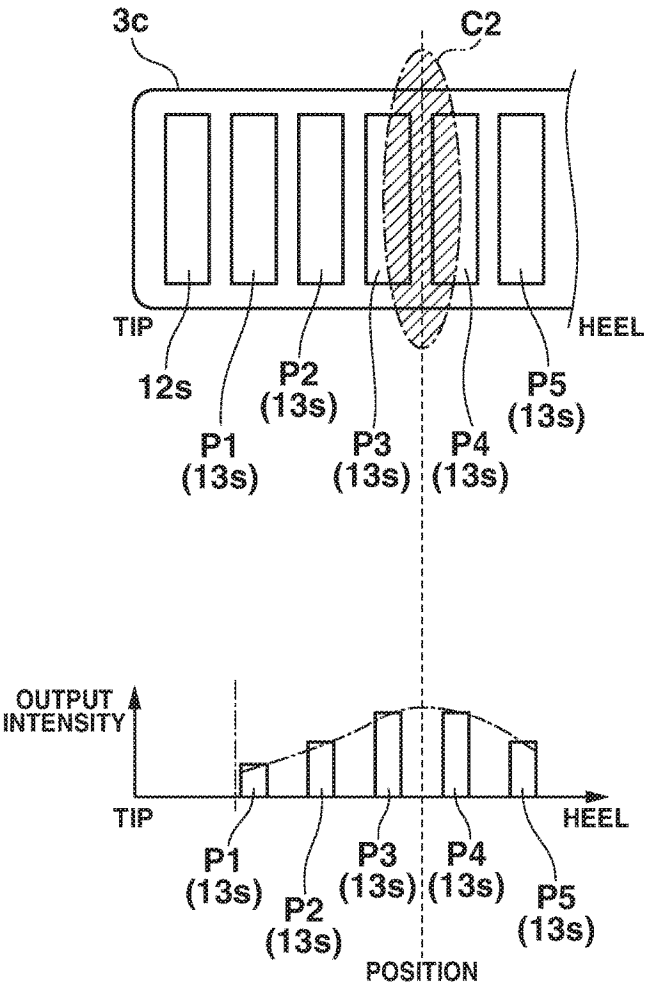

FIG. 4A and FIG. 4B are views schematically showing an area of the reed 3*c* where the lip touches and output values (output intensities) generated by the plural detecting units 13*s* of the lip sensor 13.

As shown in FIG. 4A and FIG. 4B, symbols P1, P2, P3, . . . and so on, indicating the numbers of the detecting units 13*s*, are given respectively to the plural detecting units 13*s* of the lip sensor 13 on the reed 3*c* disposed from the first end (the tip side) of the reed 3*c* toward the second end (the heel side) of the reed 3*c*.

For example, when the player touches a lip touching range C1 with his/her lip most tightly as shown in FIG. 4A, a distribution of the output intensities will be obtained with the maximum output intensity output from the detecting unit 13*s* "P2" corresponding to the lip touching range C1.

Meanwhile, when the player touches a lip touching range C2 (a range between the detecting units 13*s* "P3" and "P4") with his/her lip most tightly, as shown in FIG. 4B, the distribution of the output intensities will be obtained with the maximum output intensities output from the detecting units 13*s* "P3" and "P4" corresponding to the lip touching range C2.

As will be understood from FIG. 4A and FIG. 4B, not only the detecting units 13*s* corresponding the lip touching ranges C1 and C2 but also the detecting units 13*s* (the detecting units 13*s* "P1", "P3", "P4", and "P5" in FIG. 4A and the detecting units 13*s* "P1", "P2", and "P5" in FIG. 4B) adjacent to aforesaid detecting units 13*s* will react, too.

As described above, in detecting the lip touching range by the detecting units 13*s* of the lip sensor 13, since it is detected that a wide range is touched by the lip, it will be necessary for the detecting units 13*s* to determine which position of the reed 3*c* has likely been touched by the lip.

Provisionally, the CPU 5 calculates the center of the lip touching range, that is, the "centroid position" of the lip touching range, which will be described with reference to FIG. 5.

Figure 5:
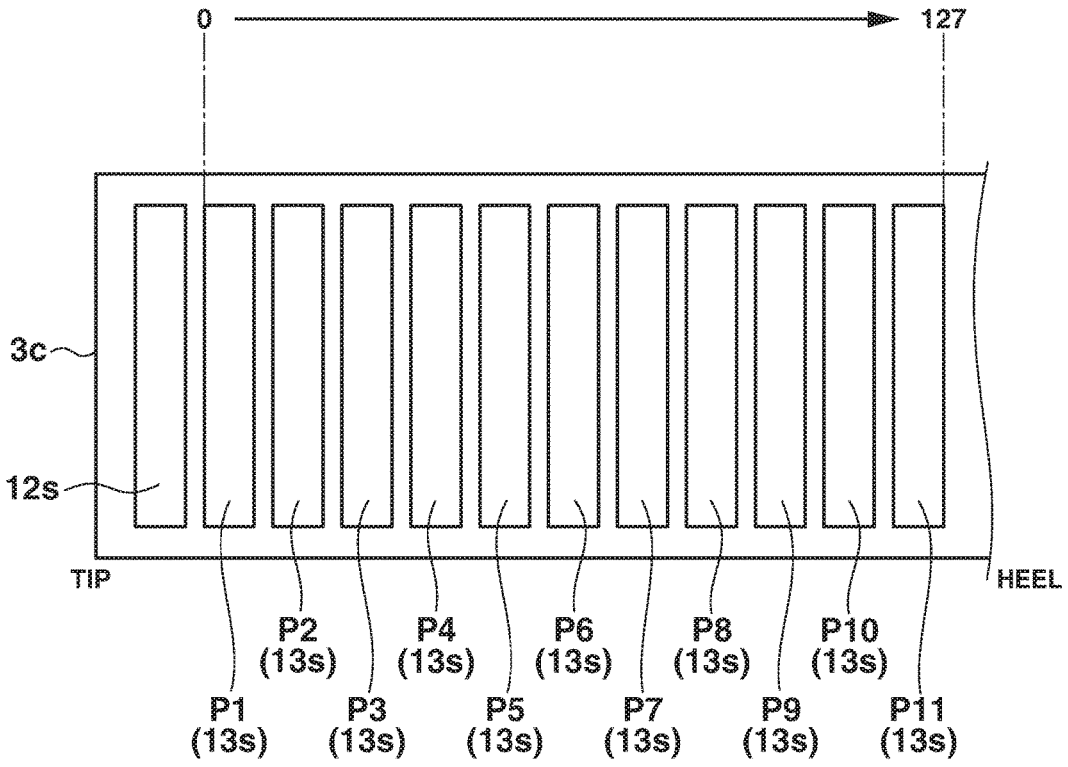
FIG. 5 is a view schematically showing a detecting unit of a tongue sensor and the plural detecting units of the lip sensor provided on a reed of the mouthpiece.

FIG. 5 is a view schematically showing the detecting unit 12*s* of the tongue sensor 12 and the plural detecting units 13*s* of the lip sensor 13 provided on the reed 3*c*.

Similarly to FIG. 4A and FIG. 4B, the symbols P1, P2, P3, . . . and so on, indicating the numbers of the detecting units 13*s* of the lip sensor 13, are given respectively to the plural detecting units 13*s* of the lip sensor 13 arranged on the reed 3*c* from the first end (the tip side) of the reed 3*c* toward the second end (the heel side) of the reed 3*c*.

More specifically, the centroid position "$x_G$" of the lip touching range will be obtained by calculating the following mathematical formula (1) to decide the lip position, where the positions of the symbols "P1" to "P11" are denoted by position numbers "$X_i$" ($X_i$=1 to 11), respectively and the detecting units 13*s* "P1" to "P11" generate output values "$m_i$", respectively.

In the present embodiment of the invention, the output values generated directly by the detecting units 13*s* are not used but the output values with noises removed are used as the output values "$m_i$".

$$x_G = \frac{\sum_{i=1}^{n} m_i x_i}{\sum_{i=1}^{n} m_i} \quad \text{FORMULA (1)}$$

where "n" denotes the number of detecting units 13*s* of the lip sensor 13. The formula (1) is the same as the formula which is generally used to calculate a centroid position.

For instance, when the output values supplied from the detecting units 13*s* corresponding respectively to the positions "P1" to "P11" are [0, 0, 0, 0, 90, 120, 150, 120, 90, 0, 0], then the centroid position "$x_G$" of the lip touching range will be given as follows:

$$x_G=(5\times90+6\times120+7\times150+8\times120+9\times90)/(90+120+150+120+90)=7.0 \quad \text{FORMULA (2)}$$

In the process performed in the musical instrument, the centroid position "$x_G$" of the lip touching range is expressed in terms of integer values from "0" to "127" (binary number of 7 bits), as shown on the upper side of FIG. 5.

The transformation of the representation of the centroid position "$x_G$" to the bit representation is the same as the general transformation of numbers to the bit representation, but since the position numbers "$x_i$", "1" to "11", are given to the detecting units 13*s*, "P1" to "P11", respectively, in the present embodiment of the invention, the minimum value of the centroid position "$x_G$" is "1" but not "0".

Therefore, when a value "0" is assigned to the centroid position "$x_G$" while this centroid position "$x_G$" takes a value of "1", a value (6.0 in the aforesaid case) calculated by subtracting 1 from the value of the centroid position "$x_G$" is used for transformation to the bit representation. In short, the value 6.0 is divided by the maximum number "11" of detecting units 13*s* and then multiplied by 127.

In the present embodiment of the invention, as described above, in consideration of the effect of noises included in the output values of the detecting units 13*s*, the value with the effect of noises removed is denoted as the output value "$m_i$" to be used in the FORMULA 1. More specifically, since the lip will not touch all the detecting units 13*s* "P1" to "P11", it is considered that the minimum output value "Pmin" supplied from the detecting units 13*s* will depend on the noises.

But the minimum output value "Pmin" of the detecting units 13*s* can be less than a general noise level. Therefore, a value "NL" (=Pmin+Sv) given by the sum of the minimum output value "Pmin" and a margin of a safety value "Sv" is used as an output value generated depending on the noises, and the values obtained by subtracting the value "NL" from all the output values of the detecting units 13*s* are used as the output value "$m_i$" of the detecting unit 13*s* which are to be used in the FORMULA 1.

But when a value of "0" or less is obtained by subtracting the value "NL" from the output value of the detecting unit 13*s*, then the output value of the detecting unit 13*s* is set to "0".

Figure 6:
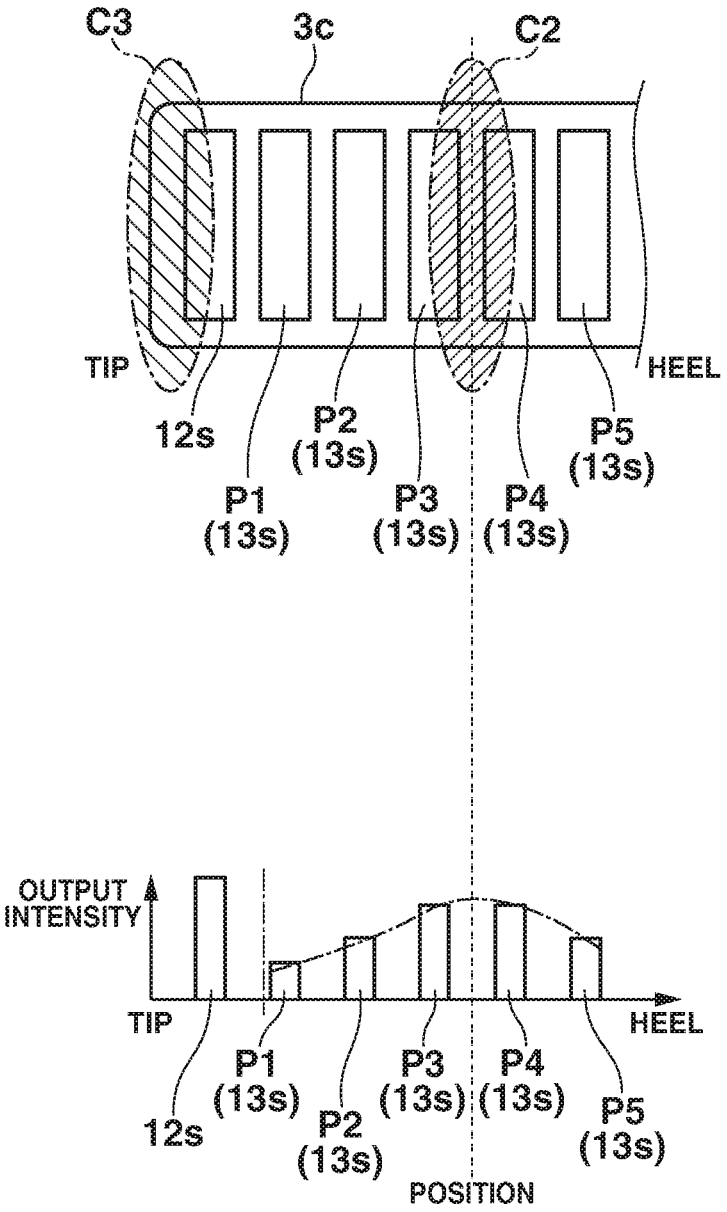
FIG. 6 is a view schematically showing a tonguing performance played on the electronic wind instrument according to the embodiment of the invention.

FIG. 6 is a view schematically showing a tonguing performance played on the electronic wind instrument 100 according to the embodiment of the invention. As will be understood from FIG. 6, when the player plays the tonguing performance, he/she touches a tongue touching range C3 with the tip of his/her tongue most tightly. Then, the detecting unit 12*s* of the tongue sensor 12 generates an output value in addition to the output values generated by the detecting unit 13*s* of the lip sensor 13.

When the detecting unit 12*s* of the tongue sensor 12 has output the output value, the CPU 5 starts executing a process (tonguing process) for the tonguing performance.

When the player touches the lip touching range C2 (the range between the detecting units 13*s* "P3" and "P4" of the lip sensor 13) with his/her lip most tightly as shown in FIG. 6, the plural detecting units 13*s* of the lip sensor 13 will generate output values.

Figure 14:
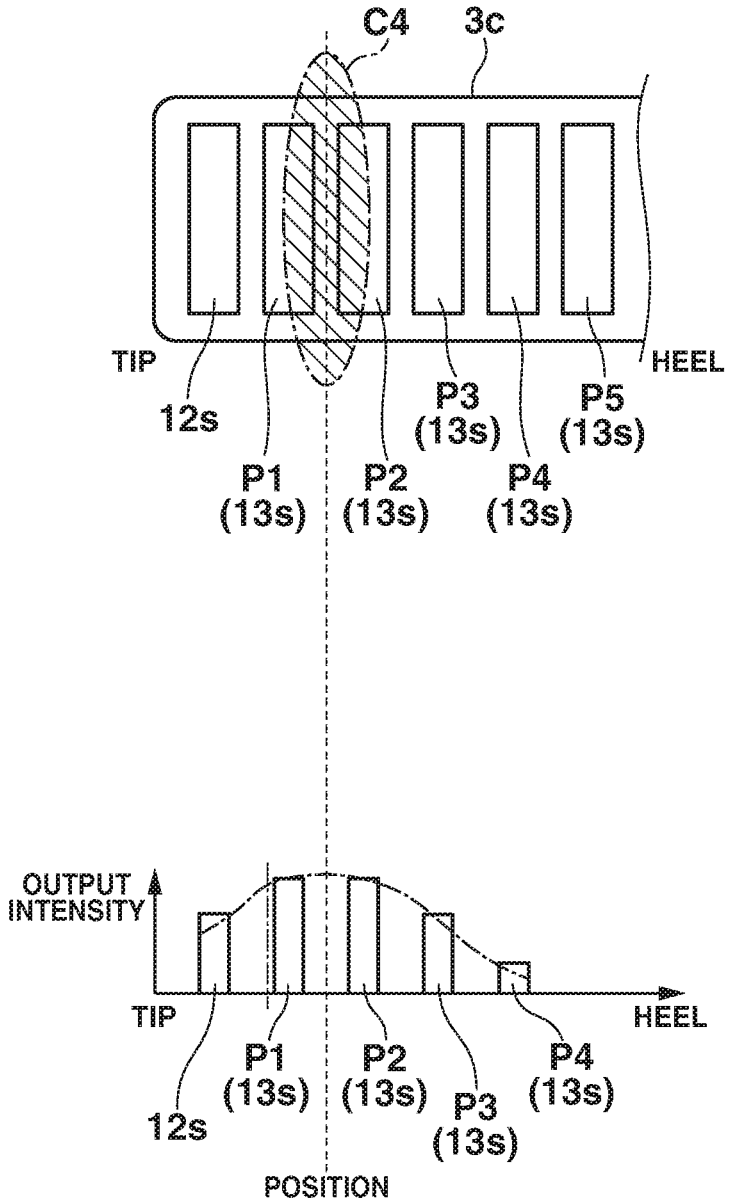
FIG. 14 is a view for explaining the output value which is generated from detecting unit of the tongue sensor, when the lip touches the lip touching region most tightly on the tip side.

Different from the tip of the tongue, the lip has a wide contacting portion, for instance, when the player touches the lip touching range C4 (the range between the detecting units 13*s* "P1" and "P2") with his/her lip most tightly, as shown in FIG. 14, the detecting unit 12*s* of the tongue sensor 12 will generate an output value under the influence of the wide contacting portion of the lip.

If the controlling system is set such that, simply when the output value generated by the detecting unit 12*s* of the tongue sensor 12 exceeds a threshold value, the tonguing process will be executed, and the CPU 5 will execute the tonguing process when the lip touches the detecting units 13*s* "P1" and "P2" of the lip sensor 13 as shown in FIG. 14, even though the player has not performed the tonguing operation.

Hereinafter, with reference to FIG. 7 to FIG. 13 will be described a method of preventing the CPU 5 from executing the tonguing process, even when the output value is generated by the detecting unit 12*s* of the tongue sensor 12 under the influence of the wide contacting portion of the lip of the player.

(Main Routine Process)

Figure 7:
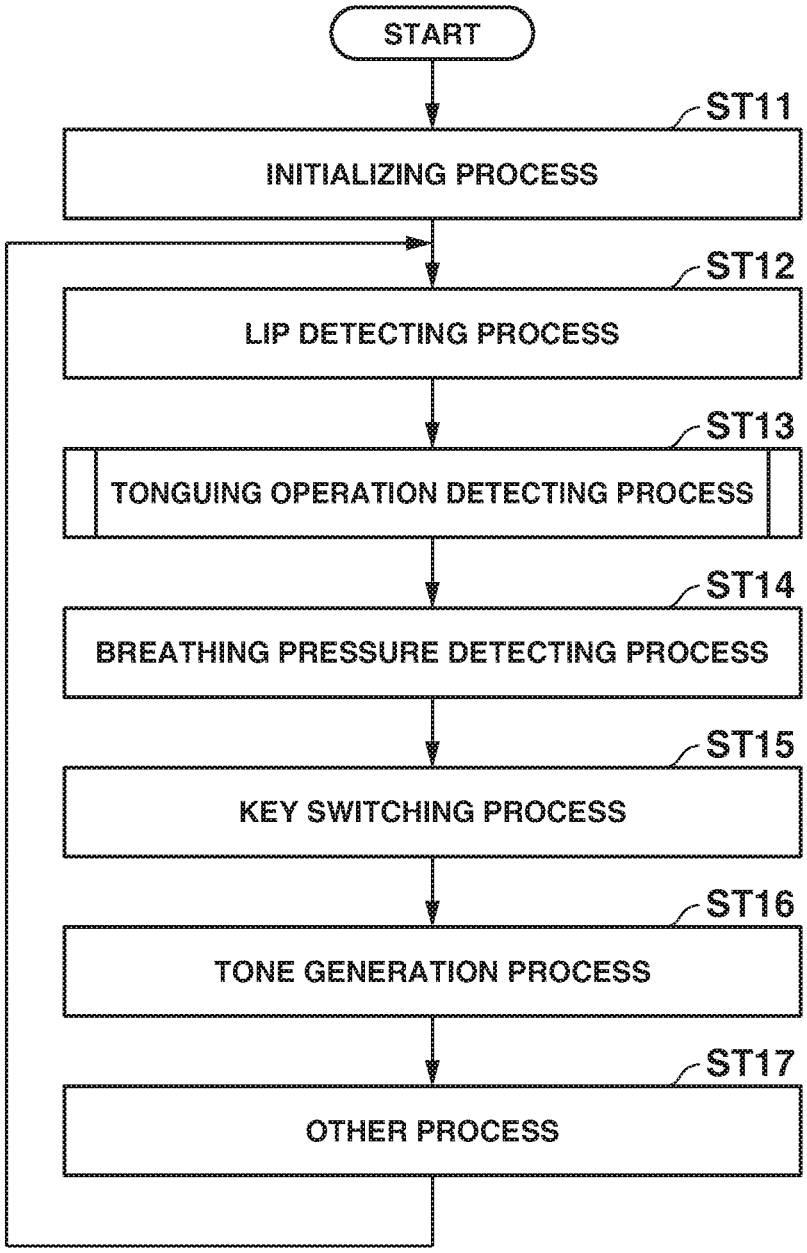
FIG. 7 is a flow chart of a main routine process.

FIG. 7 is a flow chart of a main routine process. The whole operation of the electronic wind instrument 100 will be performed in accordance with the flow chart of FIG. 7.

When a power switch is turned on, the CPU 5 performs an initializing process to initialize various setting conditions at step ST11 in FIG. 7.

The CPU 5 performs a lip detecting process at step ST12. The CPU 5 receives the output value(s) from the detecting unit(s) 13*s* of the lip sensor 13 to execute a process for calculating a lip position based on the received output value(s) (step ST12).

Further, the CPU 5 performs a tonguing operation detecting process at step ST13. The tonguing operation detecting process (step ST13) will be described later with reference to a flow chart of FIG. 13 in detail.

The CPU 5 receives an output value from the breath sensor 10 to perform a breathing pressure detecting process at step ST14, thereby deciding a tone volume. Further, the CPU 5 generates a key code corresponding to the operation information of the operator 1 and supplies the key code to the sound source 8 (a key switching process) at step ST15.

Based on the results of the processes performed at step ST12 to step ST15, the CPU 5 gives an instruction to the sound source 8. The sound source 8 controls a tone generation and/or a tone silence of the sound generating unit 2 based on the instruction of the CPU 5 at step ST 16. The CPU 5 performs other necessary process at step ST17, and returns to step ST12, again, performing repeatedly the processes at step ST12 to step ST17.

The tonguing operation detecting process (step ST13) will be described with reference to the flow chart of FIG. 13. Before explaining the tonguing operation detecting process (ST13), it will be described how the CPU 5 judges whether the output value is generated by the detecting unit 12*s* of the tongue sensor 12 depending on lip touching or tongue touching.

When the output value is generated by the detecting unit 12*s* of the tongue sensor 12 depending on the lip touching, the player's performance will be integrated into following two operations: a first operation and a second operation.

(First Operation)

When the player does not hold the mouthpiece 3 of the electronic wind instrument 100 in his/her mouth at first and then he/she holds the mouthpiece 3 in his/her mouth to play the electronic wind instrument 100, the player holds the mouthpiece 3 in his/her mouth so as to touch the mouthpiece 3 (on the tip side of the reed 3*c*) close to the detecting unit 12*s* of the tongue sensor 12 with his/her lip, allowing said detecting unit 12*s* to generate an output value. This motion of the player is called as the "First Operation".

Figure 8:
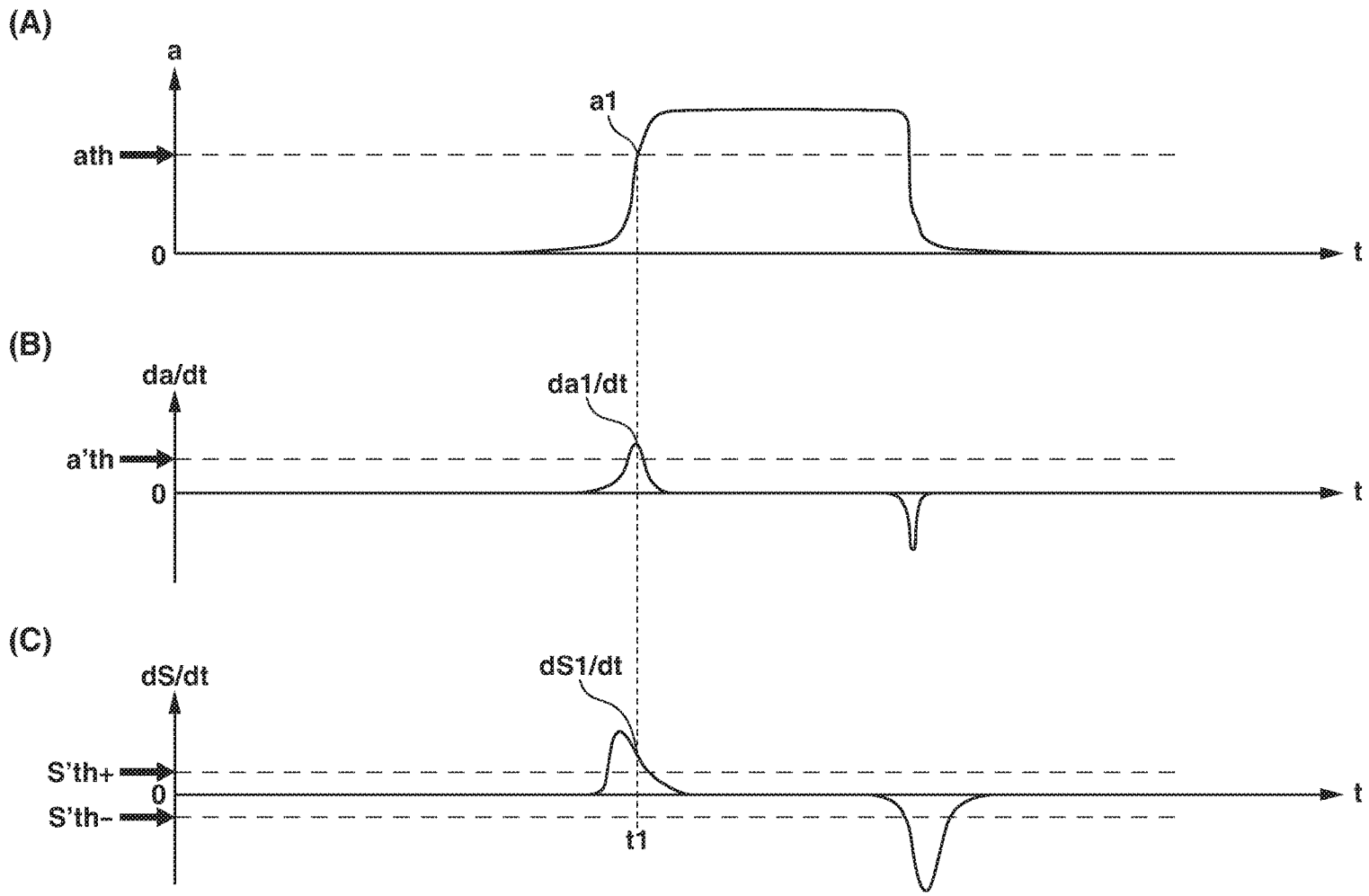
FIG. 8 is a view for explaining a state in which it is will be determined that a tonguing operation has not yet been performed or a state in which a player has held the mouthpiece in his/her mouth to start playing the instrument.

FIG. 8 is a view for explaining a state in which it is decided that the player has not yet performed the tonguing operation or a state in which the player has held the mouthpiece 3 in his/her mouth to start playing the wind instrument.

A graph (A) given on the top in FIG. 8 indicates a time transition of the output value "a" generated from the detecting unit 12*s* of the tongue sensor 12, where the horizontal axis denotes a time axis "t" and the vertical axis denotes an output value axis "a".

The detecting unit 12*s* of the tongue sensor 12 is the touch sensor disposed most close to the first end (the forefront or the tip side of the reed 3*c*) among plural touch sensors disposed along the first direction. The detecting unit 12*s* of the tongue sensor 12 is referred to as the "first sensor".

A value "ath" is a threshold value (hereinafter, the "first threshold value"), which is previously determined to referred to judge whether the player has touched the detecting unit 12*s* of the tongue sensor 12 with his/her tongue.

More specifically, when the player has held the mouthpiece 3 in his/her mouth to start playing the electronic wind instrument 100, allowing the detecting unit 12*s* of the tongue sensor 12 to start generation of an output value, the output value of the detecting unit 12*s* of the tongue sensor 12 will increase (Refer to "a1"), and when the player holds the mouthpiece 3 in his/her mouth completely, a constant output value is supplied from the detecting unit 12*s* of the tongue sensor 12. Thereafter, when the player stops holding the mouthpiece 3 in his/her mouth completely, the output value of the detecting unit 12*s* of the tongue sensor 12 will decrease to "0". The time transition of the output value "a" supplied from the detecting unit 12*s* of the tongue sensor 12 is indicated in the graph (A) in FIG. 8.

A graph (B) given in the middle of FIG. 8 indicates a differential value (hereinafter, referred to as a "first output variable", "da/dt") obtained by differentiating the output value "a" indicated in the graph (A), where the horizontal axis is the time axis "t" and the vertical axis denotes the first output variable "da/dt".

As shown by the graph (B) in FIG. 8, when the output value "a" of the detecting unit 12*s* of the tongue sensor 12 increases, a positive value (the local maximum value "da1/dt" at t1) exceeding a positive threshold value (fourth threshold value "a'th") is output. When the player holds the mouthpiece 3 in the mouth completely, the constant output value "a" is output from the detecting unit 12*s* of the tongue sensor 12 as indicated by the graph (A) and therefore, the value "da/dt" keeps constant and becomes "0". When the player does not hold the mouthpiece 3 in the mouth or releases the mouthpiece 3 from his/her mouth, the output value "a" decreases and the value "da/dt" becomes negative as indicated in the graph (B).

A graph (C) given at the bottom in FIG. 8 indicates a differential value (hereinafter, referred to as a "second output variable", "dS/dt"), where the horizontal axis is the time axis "t" and the vertical axis denotes the second output variable "dS/dt". The differential value (second output variable) "dS/dt" is obtained by differentiating the sum of the output values generated by the detecting units 13*s* of the lip sensor 13 which are disposed on the heel side of the reed 3*c* and should not generate output values in response to the tonguing operation, even if the player performed the tonguing operation. The detecting units 13*s* of the lip sensor 12 are plural touch sensors disposed along the first direction on the side of the second end (heel side) of the reed 3*c*. The detecting units 13*s* of the lip sensor 12 are the second sensors.

Figure 12:
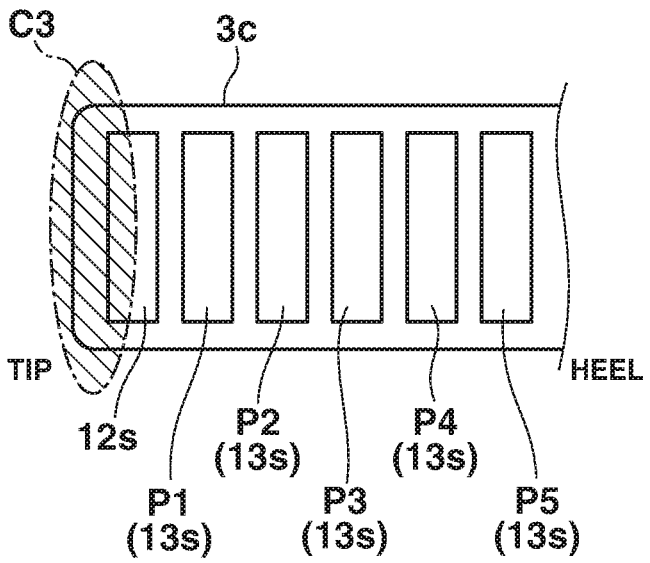
FIG. 12 is a view for explaining output values which are generated from detecting unit of the tongue sensor and the detecting unit of the lip sensor, when the tip of the tongue touches the touching region most tightly on the tip side.
Figure 12:
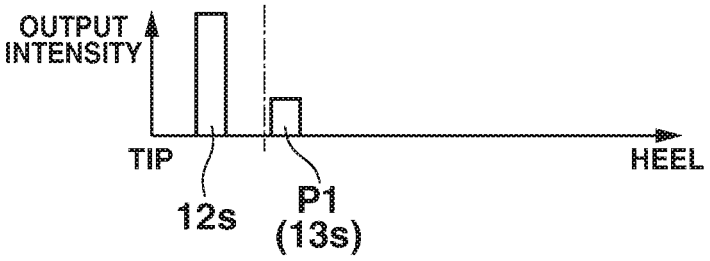

More specifically, the tonguing operation is an motion performed by the player to touch the reed 3*c* with the tip of his/her tongue, and even if the player should have touched the tongue touching range C3 with the tip of his/her tongue most tightly as shown in FIG. 12 and the detecting unit 13*s* "P1" should have generated an output value, the detecting units 13*s* "P2" to "P11" disposed on the side closer to the second end (heel side) of the reed 3*c* than the detecting unit 13*s* "P1" will not generate output values.

As described above, the detecting units 13*s* "P2" to "P11" disposed on the side of the second end (heel side) of the reed 3*c* do not generate output values, even if the player performs the tonguing operation (that is, even if the player touches the reed 3*c* with the tip of his/her tongue). These detecting units 13*s* "P2" to "P11" are sometime referred to as "special detecting units 13S".

In the present embodiment of the invention, even when the player touches the reed 3*c* with the tip of his/her tongue, the detecting units 13*s* "P2" to "P11" of the lip sensor 13 will not generate output values because of the disposed pitch and width of the detecting units 13*s* shown in FIG. 5. But when the disposed pitch and width of the detecting units 13*s* "P2" to "P11" are decreased, the detecting units 13*s* "P2" to "P11" sometime generate output values. The "special detecting units 13S" are set depending on how the detecting units 12*s* of the tongue sensor 12 and the detecting units 13*s* of the lip sensor 13 are disposed.

In the present embodiment of the invention, the detecting units 13*s* "P2" to "P11" shown in FIG. 5 are set as the special detecting units 13S, but there is no need to set all the detecting units 13*s* "P2" to "P11" disposed on the side of the second end as the special detecting units 13S, and it is possible to set only the detecting unit 13*s* "P2" as the special detecting unit 13S.

As will be understood from the later description, when the player keeps his/her lip at a position on the mouthpiece 3, which allows the detecting unit 12*s* of the tongue sensor 12 to generate an output value, the detecting units 13*s* of the lip sensor 13 disposed next to and also close to such detecting unit 12*s* of the tongue sensor 12 are set as the special detecting units 13S.

The description returns to the explanation of the graphs of FIG. 8, again. When the player holds the mouthpiece 3 in his/her mouth so as to allow the detecting unit 12*s* of the tongue sensor 12 to generate the output value, some detecting units 13*s* out of the special detecting units 13S "P2" to "P11" of the lip sensor 12 generate output values, because the lip different from the tip of tongue can touch a wide area of the reed 3*c*. As indicated in the graph (C) of FIG. 8, a positive differential value (hereinafter, the "second output variable", "dS/dt") of the sum "S" of output values from the special detecting units 13S appears.

More specifically, when the player holds the mouthpiece 3 in his/her mouth to start playing the wind instrument, the output value sum "S" of the output values from the special detecting units 13S increases and the second output variable "dS/dt" will become a positive value (Refer to "dS1/dt" at a time of "t1") exceeding a second positive threshold value "S'th+".

When the player has held the mouthpiece 3 in his/her mouth completely, the output value sum "S" of the output values from the special detecting units 13S will be constant that is, will keep constant, similarly to the output value generated from the detecting unit 12*s* of the tongue sensor 12, and the second output variable "dS/dt will become "0".

Thereafter, when the player releases the mouthpiece 3 from his/her mouth, the output value sum "S" of the output values from the special detecting units 13S will decrease, and the second output variable "dS/dt" will be a negative value falling below a third negative threshold value "S'th−".

Even though the output value "a" generated by the detecting unit 12*s* of the tongue sensor 12 should exceed the first threshold value "ath", when such output value "a" is generated ascribable to the lip touching, the second output variable "dS/dt" will exceed the second threshold value "S'th+" as indicated in the graph (C).

Therefore, when the second output variable "dS/dt" exceeds the second threshold value "S'th+" as described above, it will be possible to determine that the player is not performing the tonguing operation but the detecting unit 12*s* of the tongue sensor 12 simply detects the lip touching (Hereinafter, this state is referred to as the "LIP-STATE").

(Second Operation)

The second operation will be described. At first, the player holds the mouthpiece 3 deep in his/her mouth and the detecting unit 12*s* of the tongue sensor 12 is not made to generate an output value, and then the player moves the lip close to the detecting unit 12*s* from the heel side toward the tip side of reed 3*c*, allowing the detecting unit 12*s* of the tongue sensor 12 to generate the output value ascribable to the lip movement on the reed 3*c*. Hereinafter, the lip motion by the player is referred to as the "Second Operation". In the second operation, the player moves his/her lip on the reed 3*c* to a position close to the detecting unit 12*s* of the tongue sensor 12, allowing the detecting unit 12*s* of the tongue sensor 12 to generate the output value.

Figure 9:
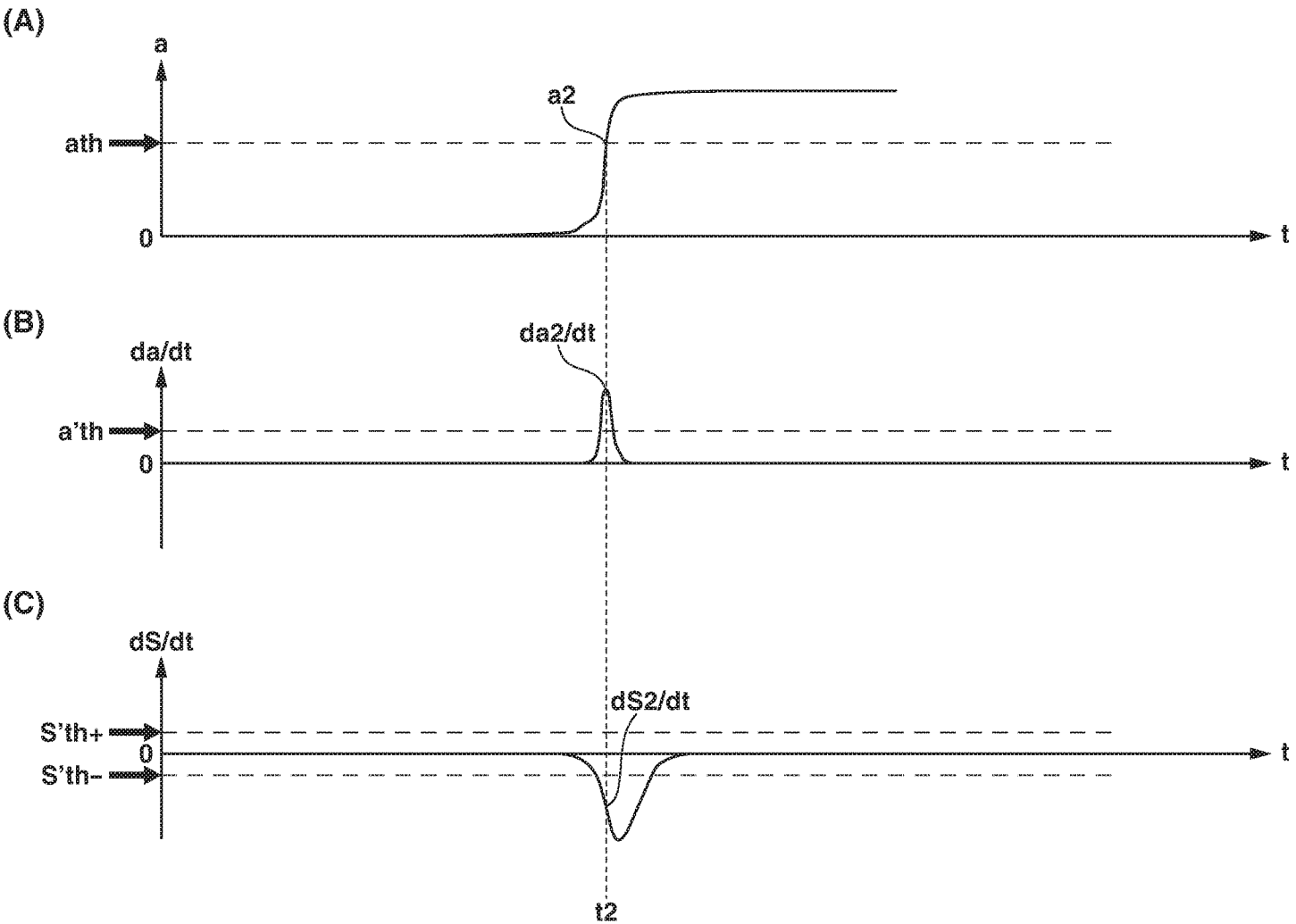
FIG. 9 is a view for explaining a state in which it is will be determined that the player is not performing the tonguing operation, in other words, a state in which the player holds the heel portion of the mouthpiece in his/her mouth and quickly re-holds the tip portion of the mouthpiece in the mouth.
Figure 10:
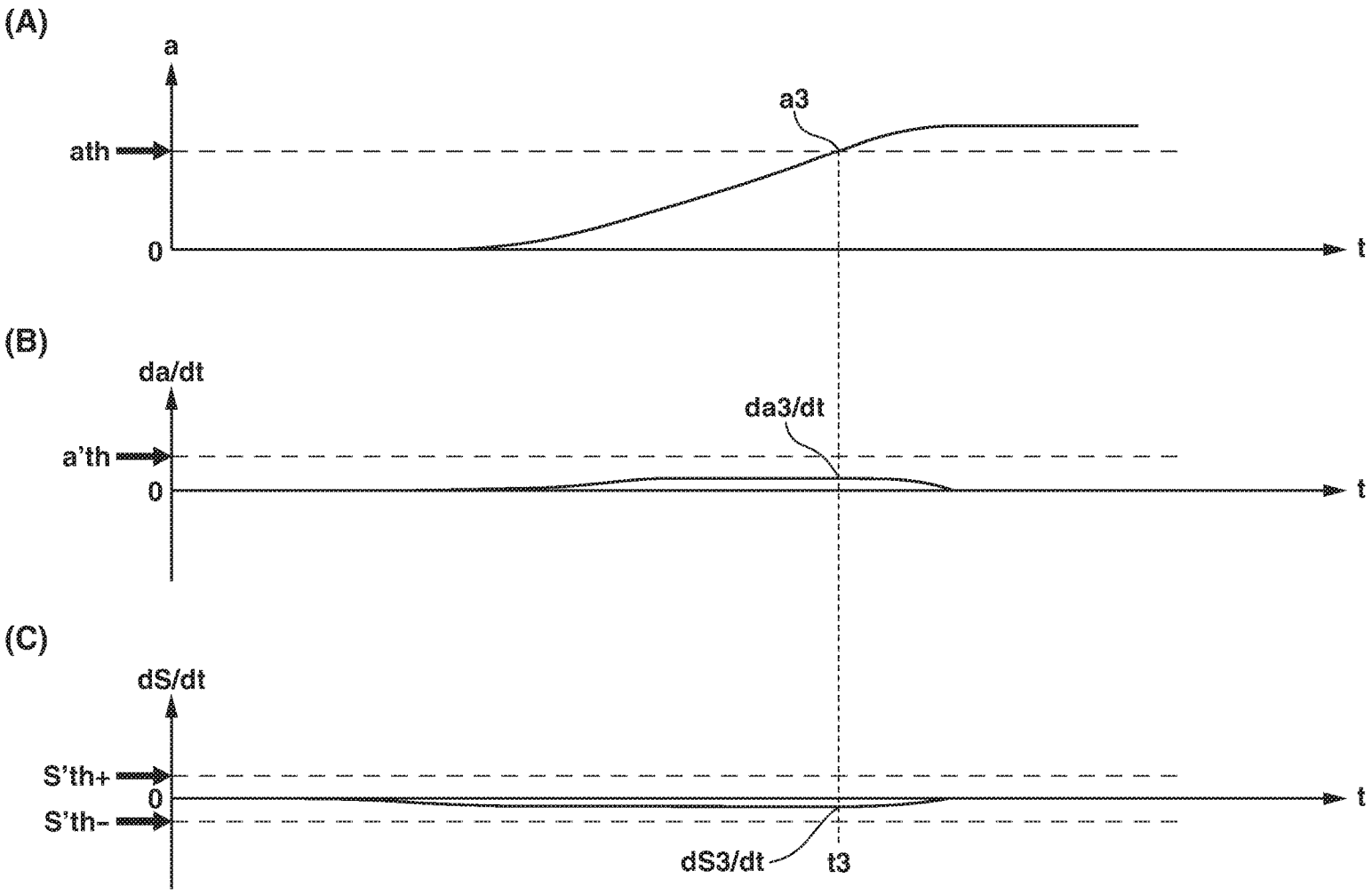
FIG. 10 is a view for explaining a state in which it is will be determined that the player is not performing the tonguing operation, in other words, a state in which the player holds the heel portion of the mouthpiece in his/her mouth and re-holds slowly the tip portion of the mouthpiece 3 in the mouth.

In the second operation, depending on the moving speed of the lip on the reed 3*c*, the output value "a" of the detecting unit 12*s* of the tongue sensor 12, the first output variable "da/dt", and the second output variable "dS/dt will take either of the states as illustrated in the graphs (A), (B) and (C) of FIG. 9 or FIG. 10.

The graphs (on the top, in the middle, and at the bottom) in FIG. 9 and FIG. 10 are corresponding to those shown in FIG. 8 respectively, and therefore, further description of the horizontal axes and vertical axes therein will be omitted.

FIG. 9 is a view for explaining a state in which it is will be determined that the player is not performing the tonguing operation. In other words, the player keeps the mouthpiece 3 in his/her mouth by holding the heel side of the reed 3*c* with the lip and then moves the lip quickly to the tip side of the reed 3*c*. This movement of the lip is explained in the graphs (A), (B) and (C) of FIG. 9.

As indicated by the graph (A) on the top in FIG. 9, when the lip comes close to the detecting unit 12*s* of the tongue sensor 12, the output value of the detecting unit 12*s* of the tongue sensor 12 will increase (Refer to "a2") and when the lip stops movement, the output value of the detecting unit 12*s* of the tongue sensor 12 will keep constant thereafter.

As indicated by the graph (B) in the middle of FIG. 9, as the output value of the detecting unit 12*s* of the tongue sensor 12 increases, the first output variable "da/dt" will exceed the fourth threshold value "a'th" (Refer to the local maximum value "da2/dt" at a time of "t2"). When the output value of the detecting unit 12*s* of the tongue sensor 12 keeps constant, the first output variable "da/dt" will become "0".

In this case, as the lip moves close to the detecting unit 12*s* of the tongue sensor 12, the lip will pass through some special detecting units 13S without touching them. As a result, on the contrary to the indicated in the graph (A) of FIG. 9, the output value sum "S" of the output values from the special detecting units 13S decreases and the second output variable "dS/dt" will be a negative value (Refer to a value of "dS2/dt" at the time of "t2") falling below the third threshold value "S'th−", as indicated in the graph (C) of FIG. 9. When the lip stops movement, the first output variable "da/dt" will keep constant and therefore the second output variable "dS/dt" will become "0".

As described above, even though the output value "a" of the detecting unit 12*s* of the tongue sensor 12 should exceed the first threshold value "ath", when the output value "a" is generated ascribed to the lip touching, the second output variable "dS/dt" will fall below the third threshold value "S'th−".

Therefore, when the second output variable "dS/dt" is smaller than the third threshold value "S'th−", it will be possible to determine that the tonguing operation is not being performed but the detecting unit 12*s* of the tongue sensor 12 has detected the lip touching ("LIP-STATE").

Meanwhile, FIG. 10 is a view for explaining a state in which it is will be determined that the player is not performing the tonguing operation. In this state, the player keeps the mouthpiece 3 in his/her mouth by holding the heel side of the reed 3*c* with the lip and then moves the lip slowly to the tip side of the reed 3*c*. In this case, as indicated by the graphs (A), (B), and (C) in FIG. 10, the second output variable "dS/dt" will be smaller than the second threshold value "S'th+" and larger than the third threshold value "S'th−". But the first output variable "da/dt" will not exceed the fourth threshold value "a'th".

Since the lip slowly comes close to the detecting unit 12*s* of the tongue sensor 12, the output value "a" from the detecting unit 12*s* of the tongue sensor 12 increases gradually as indicated in the graph (A) of FIG. 10, and even though the output value "a" from the detecting unit 12*s* of the tongue sensor 12 exceeds the first threshold value "ath" (Refer to "a3"), the first output variable "da/dt" representing an inclination of the output value "a" will not be a large value, because the inclination of the output value "a" is gentle, as indicated by the graph (B) in FIG. 10.

For the same reason, the second output variable "dS/dt" will not fall below the third threshold value "S'th−". As the lip comes close to the detecting unit 12*s* of the tongue sensor 12, the output value sum "S" of the output values from the special detecting units 13S will decrease gradually but the output value sum "S" changes gently and the second output variable "dS/dt" representing an inclination of the output value sum "S" will not be a negative large value.

Meanwhile, when the player performs the tonguing operation, the first output variable "da/dt" will not correspond to the variable "da/dt" which exceeds the fourth threshold value "a'th" as indicated in the graph (B) of FIG. 10.

Therefore, even though the lip moves slowly and the second output variable dS/dt is smaller than the second threshold value "S'th+" and larger than the third threshold value "S'th−", as far as the first output variable da/dt does not exceed the forth threshold value "a'th", it can be determined that the tonguing operation is not being performed but the detecting unit 12*s* of the tongue sensor 12 detects tongue touching the detecting unit 12*s* (LIP STATE).

The first threshold value "ath", the second threshold value "S'th+", the third threshold value "S'th−", and the forth threshold value "a'th" can be set depending on the sensibility of the lip sensor 13 and the tongue sensor 12 and previously determined threshold values are stored in the ROM 6.

Figure 11:
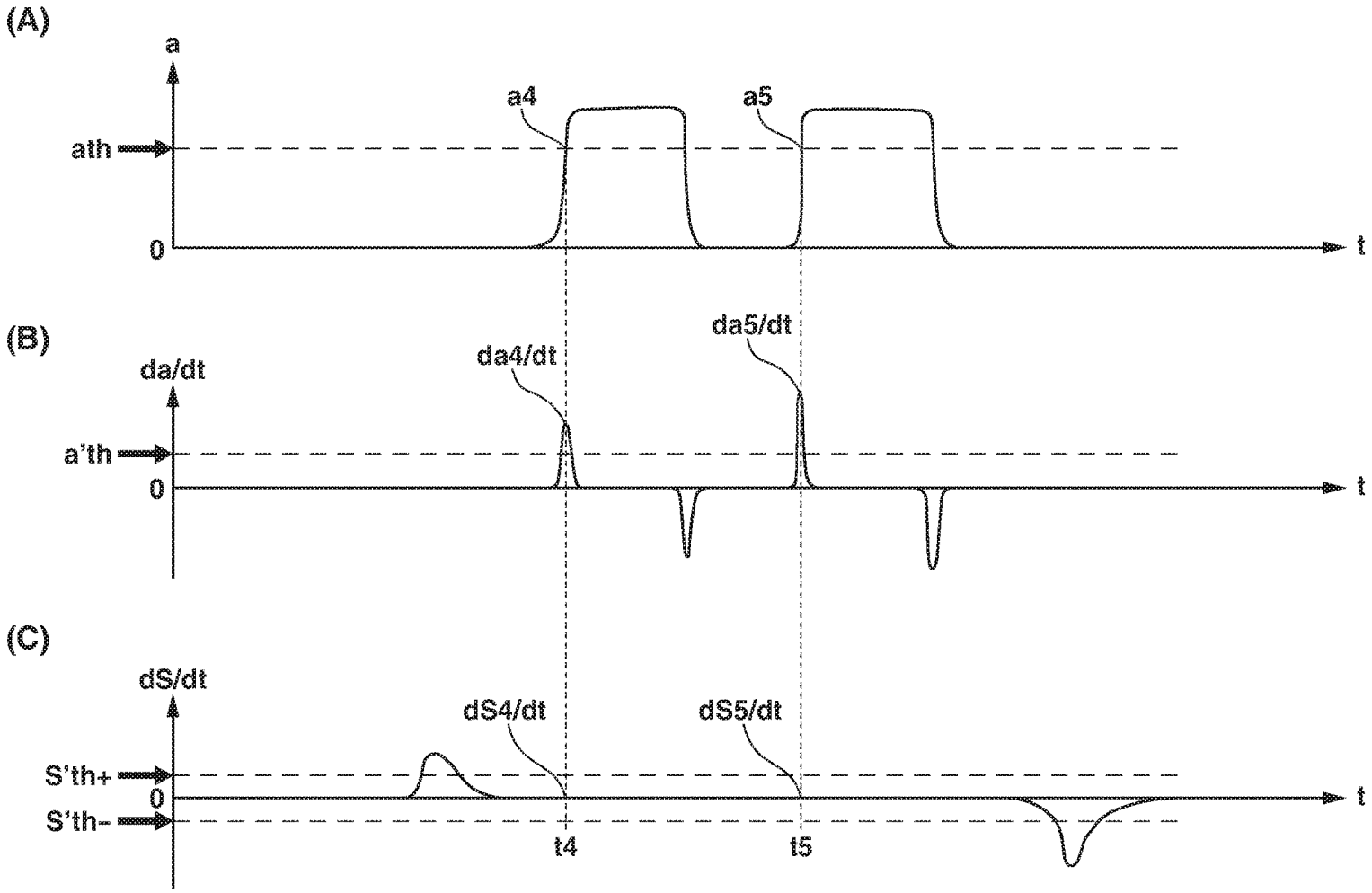
FIG. 11 is a view for explaining a state in which it will be determined that, when the player performs the tonging operation while keeping his/her lip close to the detecting unit of the tongue sensor, the player is performing the tonguing operation.

FIG. 11 is a view for explaining a state in which it will be determined that, when he/she performs the tonging operation while keeping his/her lip close to the detecting unit 12*s* of the tongue sensor 12, the player is performing the tonguing operation.

In other words, when the player performs the tonguing operation, he/she touches the detecting unit 12*s* of the tongue sensor 12 with his/her tongue (sometime repeatedly touches the detecting unit 12*s* with his/her tongue and releases his/her tongue from the detecting unit 12*s*). As a result, the output value "a" from the detecting unit 12*s* of the tongue sensor 12 exceeds the first threshold value "ath" (Refer to "a4" and "a5" in the graph (A) of FIG. 11), and the first output variable "da/dt" exceeds the fourth threshold value "a'th" (Refer to "da4/dt" at "t4" and "da5/dt" at "t5" in the graph (B) of FIG. 11). But since the lip is kept still or at rest, the second output variable "dS/dt" will become "0" (Refer to "dS4/dt" at "t4" and "dS5/dt" at "t5" in the graph (C) of FIG. 11) at the times when the output value "a" from the detecting unit 12*s* of the tongue sensor 12 and the first output variable "da/dt" exceed the threshold values, "ath" and "a'th".

As described above, even though the output value "a" from the detecting unit 12*s* of the tongue sensor 12 should exceed the first threshold value "ath" ascribed to the lip touching the detecting unit 12*s*, it will be possible to judge by focusing on the first output variable "da/dt" and the second output variable "dS/dt", whether the player has performed the tonguing operation. In addition to the above judgment, a tonguing operation detecting process (step ST13 in FIG. 7) will be descried with reference to the flow chart shown in FIG. 13 in detail. The process (step ST13) includes a process of preventing from performing the tonging operation in error.

Figure 13:
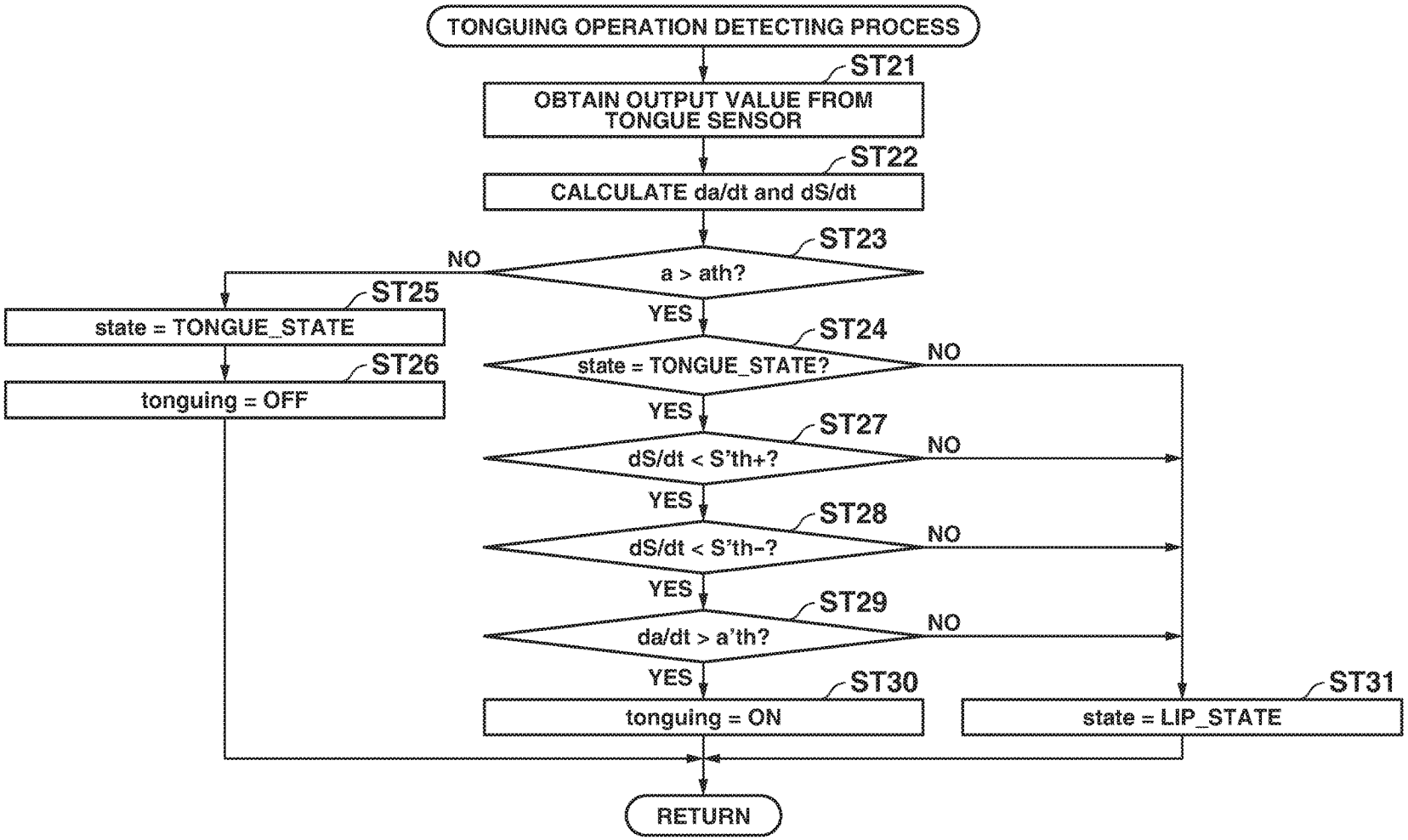
FIG. 13 is a flow chart of a tonguing operation detecting process.

The CPU 5 advances to step ST13 in FIG. 7 to perform the process in accordance with the flow chart of FIG. 13. The CPU 5 obtains the output value from the detecting unit 12*s* of the tongue sensor 12 (step ST21 in FIG. 13).

At step ST22, using the output values of the detecting units 13*s* of the lip sensor 13 obtained at step ST12 in FIG. 7, the output value "a" of the detecting unit 12*s* of the tongue sensor 12 obtained at step ST21 in FIG. 13, the output values of the detecting units 13*s* of the lip sensor 13 obtained in the previous process, and the output value "a" of the detecting unit 12*s* of the tongue sensor 12 obtained in the previous process, the CPU 5 calculates the first output variable "da/dt" representing a variation per unit time of the output value "a" of the tongue sensor 12 and the second output variable "dS/dt" representing a variation per unit time of the output value sum of the "special detecting units 13S", that is, at least one detecting unit 13*s* disposed close to the second end (heel side) among the plural detecting units 13*s* of the lip sensor 13.

Then, at step ST23, the CPU 5 compares the output value "a" generated by the detecting unit 12*s* of the tongue sensor 12 with the first threshold value "ath" read from the ROM 6.

When it is determined that the output value "a" of the detecting unit 12*s* is larger than the first threshold value "ath" (YES at step ST23), the CPU 5 advances to step ST24. When it is determined that the output value "a" of the detecting unit 12*s* is not larger than the first threshold value "ath" (NO at step ST23), the CPU 5 advances to step ST25.

Since the output value "a" of the detecting unit 12*s* is not larger than the first threshold value "ath", the CPU 5 advances to step ST25. At step ST25, not only the tongue but also the lip do not touch the detecting unit 12*s* of the tongue sensor 12.

Therefore, since the player is allowed to perform the tonguing operation always, the CPU 5 sets a "TONGUE STATE", in which the player is always allowed to perform the tonguing operation (step ST25).

Further, since the output value "a" of the detecting unit 12*s* is not larger than the first threshold value "ath", the CPU 5 sets OFF to the tonguing process at step ST26, returning to the main routine process of FIG. 7.

The tonguing process could be set to ON incidentally in the previous tonguing operation detecting process. In this case, it will be necessary to finish such tonguing process, when the output value of the tongue sensor 12 has been detected. Therefore, the CPU 5 sets the tonguing process to OFF at step ST26.

The tonguing process is not set to ON in the previous tonguing operation detecting process, the tonguing process is kept set OFF.

Meanwhile, when the output value "a" of the detecting unit 12*s* is larger than the first threshold value "ath" and the CPU 5 advances from step ST 23 to step ST24, the CPU 5 judges whether the "TONGUE STATE" has been set.

When the CPU 5 advances to step ST31 depending on the results of the judgments which will be made at steps ST27 to ST29, the CPU 5 will set the "LIP STATE", in which the lip touching has been detected by the detecting unit 12*s* of the tongue sensor 12.

When the "LIP STATE" was set in the previous tonguing operation detecting process and the CPU 5 advances to step ST24 in the current tonguing operation detecting process, it means that the "TONGUE STATE" has not been set currently, that is, the tonguing operation is not allowed.

Therefore, when it is determined that "TONGUE STATE" has not been set (NO at step ST24), since the "LIP STATE" set in the previous process is still kept, the CPU 5 advances to step ST31 to keep setting the "LIP STATE", returning to the main routine process of FIG. 7.

Meanwhile when it is determined that "TONGUE STATE" has been set (YES at step ST24), the CPU 5 executes a process for judging whether the "LIP STATE" has been set, in which the lip touching has been detected by the detecting unit 12*s* of the tongue sensor 12.

More specifically, the CPU 5 compares the second output variable "dS/dt" with the second threshold value "S'th+" read from the ROM 6 (step ST27).

When it is determined that the second output variable "dS/dt" is larger than the second threshold value "S'th+" (NO at step ST27), that is, this case means that the lip touching has been detected by the detecting unit 12*s* of the tongue sensor 12 (Refer to FIG. 8), then the CPU 5 advances to step ST31 to set the "LIP STATE", returning to the main routine process of FIG. 7.

Meanwhile when it is determined that the second output variable "dS/dt" is not larger than the second threshold value "S'th+" (YES at step ST27), the CPU 5 advances to step ST28 to compare the second output variable "dS/dt" with the third threshold value "S'th−" read from the ROM 6.

When it is determined that the second output variable "dS/dt" is not larger than the third threshold value "S'th−" (NO at step ST28), that is, this case means that the lip touching has been detected by the detecting unit 12*s* of the tongue sensor 12 (Refer to FIG. 9), then the CPU 5 advances to step ST31 to set the "LIP STATE", returning to the main routine process of FIG. 7.

Meanwhile when it is determined that the second output variable "dS/dt" is larger than the third threshold value "S'th−" (YES at step ST28), the CPU 5 advances to step ST29 to compare the first output variable "da/dt" with the forth threshold value "a'th" read from the ROM 6.

When it is determined that the first output variable "da/dt" is not larger than the forth threshold value "a'th" (NO at step ST29), that is, this case means that the lip touching has been detected by the detecting unit 12*s* of the tongue sensor 12 (Refer to FIG. 10), then the CPU 5 advances to step ST31 to set the "LIP STATE", returning to the main routine process of FIG. 7.

Meanwhile when it is determined that the first output variable "da/dt" is larger than the forth threshold value "a'th" (YES at step ST29), that is, this case does not correspond to any state in which the lip touching has been detected by the detecting unit 12*s* of the tongue sensor 12 (Refer to FIG. 10), then the CPU 5 advances to step ST30 to set the tonguing process to ON and returns to the main routine process of FIG. 7.

As described above, when the output value "a" of the detecting unit 12*s* of the tongue sensor 12 functioning as the first sensor reaches the first threshold value "ath", the CPU 5 performs not only the normal tonguing process while performing the tonguing operation detecting process of FIG. 13, but also controls not to perform the tonguing process, preventing the tongue sensor 12 from performing the tonguing process when the lip touches the tongue sensor 12.

More particularly, even though the output value "a" of the detecting unit 12*s* functioning as the first sensor has reached the first threshold value "ath", when the second output variable "dS/dt" reaches the second threshold value "S'th+", the CPU 5 does not set the tonguing process to ON, and therefore the CPU 5 will control not to perform the tonguing process in the main routine process of FIG. 7.

Similarly, even though the output value "a" of the detecting unit 12*s* functioning as the first sensor has reached the first threshold value "ath", when the second output variable "dS/dt" reaches the third threshold value "S'th−", the CPU 5 does not set the tonguing process to ON, and therefore the CPU 5 will control not to perform the tonguing process in the main routine process of FIG. 7.

Further, even though the output value "a" of the detecting unit 12*s* functioning as the first sensor has reached the first threshold value "ath", even when the first output variable "da/dt" does not reach the fourth threshold value "a'th", the CPU 5 does not set the tonguing process to ON, and therefore the CPU 5 will control not to perform the tonguing process in the main routine process of FIG. 7.

Furthermore, when the output value "a" of the detecting unit 12*s* functioning as the first sensor has reached the first threshold value "ath", the first output variable "da/dt" has reached the fourth threshold value "a'th", the second output variable "dS/dt" has not reached the second threshold value "S'th+", and the second output variable "dS/dt" has not reached the third threshold value "S'th−", the CPU 5 sets the tonguing process to ON. As a result, the CPU 5 will control to perform the tonguing process in the main routine process of FIG. 7.

In the tonguing operation detecting process shown in FIG. 13, when the lip touches the tongue sensor 12, the tonguing process is not set to ON. Therefore, in the main routine process of FIG. 7, it will be possible to prevent the tonguing process from being performed. Meanwhile, when the tongue touches the tongue sensor 12, the tonguing process is set to ON. Therefore, it will be possible in the main routine process of FIG. 7 to perform the tonguing process correctly.

In the aforesaid description, the present invention has been described with reference to the detailed embodiment, it will be understood that the invention is not limited to the particular embodiments described herein, but modifications and rearrangements may be made to the disclosed embodiments while remaining within the scope of the invention as defined by the following claims. It is intended to include all such modifications and rearrangements in the following claims and their equivalents.

In the embodiment described herein, the controlling unit for performing various controlling operations is composed of the CPU (general purpose processor) which executes programs stored in the ROM (memory). It is possible to compose the controlling unit with plural processors each specialized in performing its special controlling operation. In this case, the specialized processor is composed of a general purpose processor (electronic circuit) which can execute an arbitrary program and a memory storing a controlling program specialized in the special controlling operation. The electronic circuits may be specialized in the special controlling operations respectively.

The construction of the apparatus which provides the above various effects can be composed of as follows, but not always restricted to the following:

Construction Example 1

The apparatus has plural touch sensors disposed on the apparatus along a first direction and a processor which judges based on a first output variable and a second output variable whether a tonging process should be performed, wherein the first output variable represents a variation per unit time of an output value from a first sensor among the plural touch sensors, which first sensor is disposed on the side close to a first end in the first direction, and the second output variable represents a variation per unit time of output values from at least one or more second sensors among the plural touch sensors which are disposed between a second end in the first direction and the first sensor.

Construction Example 2

In the above construction example, wherein the processor does not perform the tonguing process, when an output value from the first sensor does not reach a first threshold value, and the processor judges based on the first output variable and the second output variable whether the tonging process should be performed, when the output value from the first sensor reaches the first threshold value.

Construction Example 3

In the above construction example, wherein the processor judges based on the second output variable whether the tonging process should be performed, when the output value from the first sensor reaches the first threshold value and the first output variable reaches a fourth threshold value.

Construction Example 4

In the above construction example, wherein the second output variable represents a variation per unit time of an output value sum of the output values from plural second sensors among the plural touch sensors, which second sensors are disposed on the side close to the second end in the first direction.

Construction Example 5

In the above construction example, wherein even though an output value from the first sensor reaches a first threshold value, the processor does not perform the tonguing process when the second output variable reaches a second positive threshold value.

Construction Example 6

In the above construction example, wherein even though an output value from the first sensor reaches a first threshold value, the processor does not perform the tonguing process when the second output variable reaches a third negative threshold value.

Construction Example 7

In the above construction example, wherein even though an output value from the first sensor reaches a first threshold value, the processor does not perform the tonguing process when the first output variable does not reach a fourth threshold value.

Construction Example 8

In the above construction example, wherein when an output value from the first sensor reaches a first threshold value, the first output variable reaches a fourth threshold value, the second output variable does not reach a second positive threshold value, and the second output variable does not reach a third negative threshold value, the processor performs the tonguing process.

Construction Example 9

In the above construction example, wherein there is included a sensor other than the first sensor and the second sensor between the first sensor and the second sensor among the plural touch sensors disposed along the first direction.

Construction Example 10

In the above construction example, wherein the plural touch sensors disposed along the first direction are capacitance sensors.

Construction Example 11

In the above construction example, wherein the processor generates a musical tone based on a value detected by a breath sensor which detects breath, and also controls sound attenuation of the generated musical tone in accordance with the performed tonguing process.

Construction Example 12

In the above construction example, wherein the processor controls a vibrato performance or a sub tone performance in accordance with an output value from the second sensor.

What is claimed is:

1. An electronic wind instrument comprising:

a plurality of touch sensors disposed on the wind instrument along a first direction; and a processor which judges based on a first output variable and a second output variable whether a tonguing process should be performed, wherein:

the first output variable represents a variation per unit time of an output value from a first sensor among the plurality of touch sensors, the first sensor being disposed on a side close to a first end in the first direction; and the second output variable represents a variation per unit time of at least one output value from at least one second sensor among the plurality of touch sensors, the at least one second sensor being disposed between a second end in the first direction and the first sensor.

2. The electronic wind instrument according to claim 1, wherein:

the processor does not perform the tonguing process, when the output value from the first sensor does not reach a first threshold value, and the processor judges based on the first output variable and the second output variable whether the tonguing process should be performed, when the output value from the first sensor reaches the first threshold value.

3. The electronic wind instrument according to claim 2, wherein the processor judges based on the first output variable and the second output variable whether the tonguing process should be performed, when the output value from the first sensor reaches the first threshold value and the first output variable reaches a fourth threshold value.

4. The electronic wind instrument according to claim 1, wherein the second output variable represents a variation per unit time of an output value sum of output values from a plurality of second sensors among the plurality of touch sensors, the plurality of second sensors being disposed on a side close to the second end in the first direction.

5. The electronic wind instrument according to claim 1, wherein the processor does not perform the tonguing process when the second output variable reaches a second positive threshold value, even if the output value from the first sensor reaches a first threshold value.

6. The electronic wind instrument according to claim 1, wherein the processor does not perform the tonguing process when the second output variable reaches a third negative threshold value, even if the output value from the first sensor reaches a first threshold value.

7. The electronic wind instrument according to claim 1, wherein the processor does not perform the tonguing process when the first output variable does not reach a fourth threshold value, even if the output value from the first sensor reaches a first threshold value.

8. The electronic wind instrument according to claim 1, wherein when the output value from the first sensor reaches a first threshold value, the first output variable reaches a fourth threshold value, the second output variable does not reach a second positive threshold value, and the second output variable does not reach a third negative threshold value, the processor performs the tonguing process.

9. The electronic wind instrument according to claim 1, wherein the plurality of touch sensors include a sensor other than the first sensor and the second sensor between the first sensor and the second sensor.

10. The electronic wind instrument according to claim 1, wherein the plurality of touch sensors disposed along the first direction are capacitance sensors.

11. The electronic wind instrument according to claim 1, wherein the processor generates a musical tone based on a value detected by a breath sensor which detects breath, and also controls sound attenuation of the generated musical tone in accordance with the tonguing process when the tonguing process is performed.

12. The electronic wind instrument according to claim 1, wherein the processor controls a vibrato performance or a sub tone performance in accordance with the at least one output value from the at least one second sensor.

13. A method comprising:

judging based on a first output variable and a second output variable whether a tonguing process should be performed in an electronic wind instrument, the electronic wind instrument including a plurality of touch sensors disposed on the wind instrument along a first direction, wherein:

the first output variable represents a variation per unit time of an output value from a first sensor among the plurality of touch sensors, first sensor being disposed on a side close to a first end in the first direction, and the second output variable represents a variation per unit time of at least one output value from at least one second sensor among the plurality of touch sensors, the at least one second sensor being disposed between a second end in the first direction and the first sensor.

14. A non-transitory computer-readable recording medium having a program stored thereon that is executable by a computer of an electronic wind instrument, the electronic wind instrument including a plurality of touch sensors disposed on the wind instrument along a first direction, and the program being executable by the computer to perform operations comprising:

judging, based on a first output variable and a second output variable whether a tonguing process should be performed, wherein:

the first output variable represents a variation per unit time of an output value from a first sensor among the plurality of touch sensors, first sensor being disposed on a side close to a first end in the first direction, and the second output variable represents a variation per unit time of at least one output value from at least one second sensor among the plurality of touch sensors, the at least one second sensor being disposed between a second end in the first direction and the first sensor.

* * * * *